US006401874B2

(12) United States Patent
Siikonen

(10) Patent No.: US 6,401,874 B2
(45) **Date of Patent: *Jun. 11, 2002**

(54) DOUBLE-DECK ELEVATOR GROUP CONTROLLER FOR CALL ALLOCATION BASED ON MONITORED PASSENGER FLOW AND ELEVATOR STATUS

(76) Inventor: Marja-Liisa Siikonen, Sotkatie 4 A 2 00200, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/771,597

(22) Filed: Jan. 30, 2001

Related U.S. Application Data

(62) Division of application No. 09/155,154, filed as application No. PCT/FI98/00065 on Jan. 23, 1998.

(30) Foreign Application Priority Data

Jan. 23, 1997 (FI) ..... 970282

(51) Int. Cl.[7] ..... B66B 1/18
(52) U.S. Cl. ..... 187/382; 187/902
(58) Field of Search ..... 127/902, 382, 127/384, 380, 387, 392, 391, 385, 386, 281, 383

(56) References Cited

U.S. PATENT DOCUMENTS

| | | | | |
|---|---|---|---|---|
| 4,582,173 | A | 4/1986 | Schroder | 187/29 R |
| 4,632,224 | A | 12/1986 | Nowak et al. | 127/29 R |
| 4,793,443 | A | 12/1988 | MacDonald et al. | |
| 4,836,336 | A | 6/1989 | Schorder | |
| 4,838,385 | A | 6/1989 | Ekholm et al. | |
| 4,878,562 | A | 11/1989 | Schroder | |
| 4,993,518 | A | 2/1991 | Van Straaten et al. | 187/127 |
| 5,024,295 | A | 6/1991 | Thangavelu | |
| 5,086,883 | A | 2/1992 | Schroder | |
| 5,229,559 | A | 7/1993 | Siikonen et al. | |
| 5,354,957 | A | 10/1994 | Robertson | |
| 5,490,580 | A | 2/1996 | Powell et al. | |
| 5,616,896 | A | 4/1997 | Kontturi et al. | 187/384 |
| 5,625,176 | A | 4/1997 | Davis et al. | 187/393 |
| 5,844,179 | A | 12/1998 | Walker et al. | 187/382 |
| 5,861,587 | A | 1/1999 | Powell et al. | 127/382 |
| 6,129,182 | A | 10/2000 | Nakamura | 187/391 |

FOREIGN PATENT DOCUMENTS

| | | | |
|---|---|---|---|
| EP | 0653370 | A2 * | 10/1994 |
| JP | 10212078 | | 9/1997 |

* cited by examiner

*Primary Examiner*—Jonathan Salata

(57) ABSTRACT

A procedure for controlling an elevator group consisting of double deck elevators consists of allocating landing calls to elevators and elevator decks in such a way that passenger journey time is optimized. The time of the call and the estimated time of arrival to destination floor are taken into account. Passenger flow and elevator status within the elevator group are monitored and passenger wait time and arrive time estimated based thereon. The best elevator is selected to minimize passenger wait and ride time. The best deck is further selected based on the estimated wait time and ride time to minimize passenger journey time.

19 Claims, 2 Drawing Sheets

Figure 1:
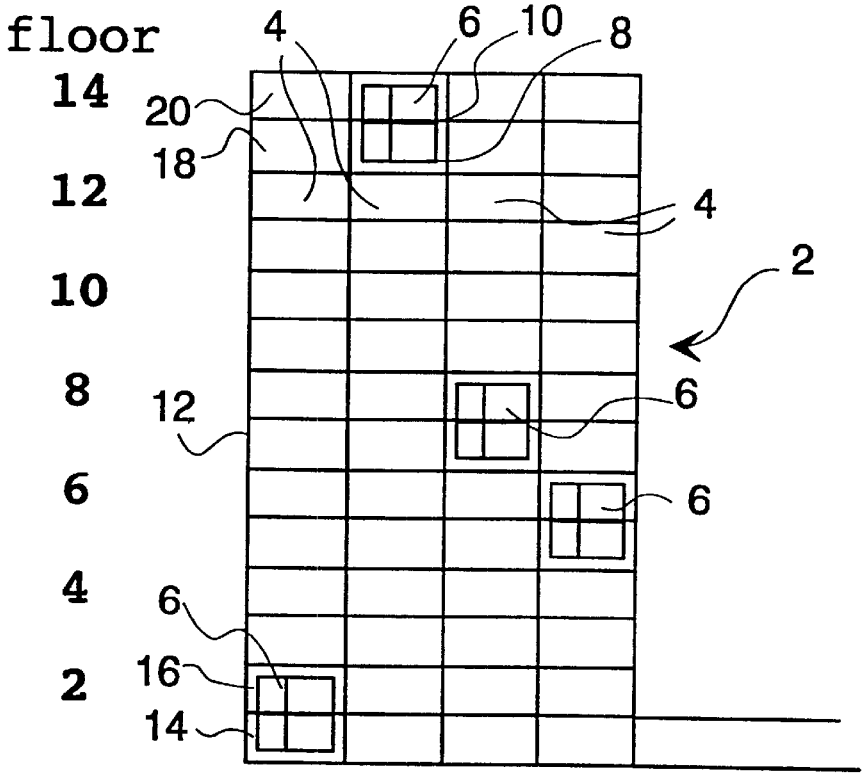

DOUBLE-DECK ELEVATOR GROUP CONTROLLER FOR CALL ALLOCATION BASED ON MONITORED PASSENGER FLOW AND ELEVATOR STATUS

This application is a divisional of co-pending application Ser. No. 09/155,154, filed on Nov.10, 1998 and for which priority is claimed under 35 U.S.C. §120. Application No. 09/155,154 is the national phase of PCT International Application No. PCT/FI98/00065 filed on Jan. 23, 1998 under 35 U.S.C. §371. The entire contents of each of the above-identified applications are hereby incorporated by reference. This application also claims priority of Application No. 970282 filed in Finland on Jan. 23, 1997 under 35 U.S.C. § 119.

The present invention relates to a procedure for controlling an elevator group, as defined in the preamble of claim 1.

When a number of elevators form an elevator group that serves passengers arriving in the same lobby, the elevators are controlled by a common group controller. The group control system determines which elevator will serve a given landing call waiting to be served. The practical implementation of group control depends on how many elevators the group comprises and how the effects of different factors are weighted. Group control can be designed to optimise cost functions, which include considering e.g. the passenger waiting time, the number of departures of the elevators, the passenger ride time, the passenger journey time or combinations of these with different weighting of the various factors. The group control also defines the type of control policy to be followed by the elevator group.

Additional features will be added to group control when the elevators are double-deckers, where two decks are attached on top of each other in a frame and the elevator serves two building floors simultaneously when the elevator stops.

A conventional control solution is based on collective control, in which the elevator always stops to serve the nearest landing call in the drive direction. If the call is allocated to the trailing car, coincidences with possible landing calls from the next floor are maxinised. Collective control in elevators with normal cars is ineffective in outgoing and mixed traffic. The consequence is bunching and bad service for the lowest floors. The same applies to collective control of double-deck elevators. For example, specification U.S. Pat. No. 4,632,224 presents a collective control system for double-deck elevators in which a landing call is allocated to the trailing car in the travelling direction of the elevator, in other words, when the elevator is moving down, the landing call is allocated to the upper deck, and when the elevator is moving up, the landing call is allocated to the lower deck. Another specification U.S. Pat. No. 4,582,173 discloses a group control for a double deck elevator calculating internal costs corresponding to the waiting times inside the car during the stops and external costs corresponding to the waiting times on the landing call floors. In this control only the operating costs consisting of these time losses of the passengers are minimised.

The object of the invention is to achieve a new procedure for controlling an elevator group in order to improve passenger journey times, i.e. the total time spent in an elevator system and to allow better utilisation of the capacity of the elevator group. To implement this, the invention is characterised by the features presented in the characterisation part of claim 1.

Certain other embodiments of the invention are characterised by the features presented in the characterisation parts of the sub-claims. According to one feature if the invention the journey time consisting of waiting time at the landing call floor and ride time inside a car to the destination floor, is optimised by minimising the passenger waiting time and ride time. Especially the journey time is optimised so that a landing call for an elevator comprising two decks is selected by minimising the passenger waiting time and the best deck to serve the landing call is selected by minimising the passenger journey time.

In a preferred application of the invention the passenger waiting time is optimised by minimising a waiting time forecast $WTF_{etc}$, which comprises the current landing call time weighted by the number of persons waiting behind the call and the estimated time of arrival of a car to the landing call. All the passengers waiting the serving car is in this modification taken into account.

In another modification of the invention the passenger journey time is minimised by allocating the landing call to the deck that will cause the fewest additional stops to the elevator and least additional delay on the way to the passenger destination floor. Also the passenger ride comfort increases as the number of stops decreases.

In a further embodiment of the invention the elevator estimated time of arrival ETA to the destination floor is calculated separately for each deck, taking into account the stops already existing for the elevator and the additional stops caused by the selected landing call, and the landing call is allocated to the deck for which the estimated time of arrival to the destination floor is smallest.

In a preferred modification of the invention the best deck for each landing call is selected by minimising the cost function. The cost function may comprise the estimated time of arrival $ETA_d$ to the destination floor. Alternatively, the cost function may also comprise the estimated time of arrival $ETA_f$ to the furthest call floor.

Advantageously, when calculating the ETA, the future stops and stop times are based on the existing car calls and landing call stops and on the additional stops and delays caused by the call to be selected. The additional delays caused by the landing call to be selected are obtained from the statistical forecasts of passenger traffic, which includes passenger arrival and exit rates at each floors at each time of the day.

The solution of the invention allows a substantial increase in the capacity of an elevator group consisting of double-deck elevators as compared with solutions based on collective control. In the solution of the invention, passenger service is taken into consideration. Shorter journey and elevator round trip times are achieved which increases the handling capacity. The level of service to passengers is also substantially improved.

The optimisation of passenger waiting times the invention has been compared with a prior-art method in which only the call times are optimised. Passenger waiting time starts when a passenger arrives to a lobby and ends when he enters a car. Call time starts when the passenger pushes a call button and ends when the landing call is cancelled. These times are different especially during heavy traffic intensity. Number of passengers is obtained from the statistical forecasts. The average waiting times for outgoing traffic especially in heavy traffic conditions were clearly shorter. As for waiting times of each floor, the average waiting times are shorter and better balanced at different floors, especially at the busiest floors. The control procedure keeps the elevators apart from each other, evenly spaced in different parts of the building. The best car to serve a landing call is so selected that coincident calls, i.e. car calls and allocated landing calls, will be taken into account.

The average and maximum call times are also reduced. The invention produces effective service and short waiting times especially during lunch-time traffic and in buildings having several entrance floors, which is difficult to achieve with conventional control procedures.

Figure 3:
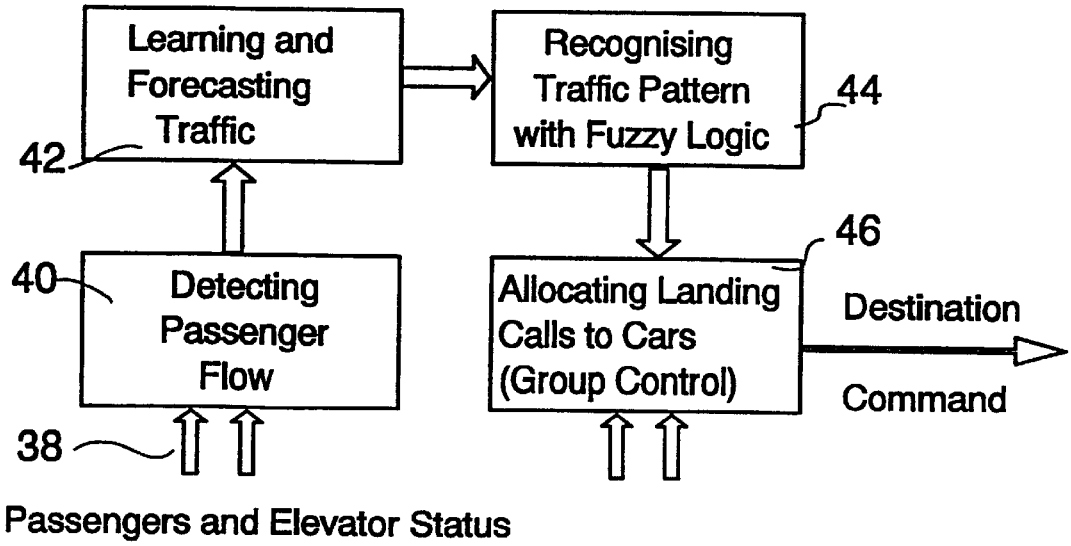
Figure 2:
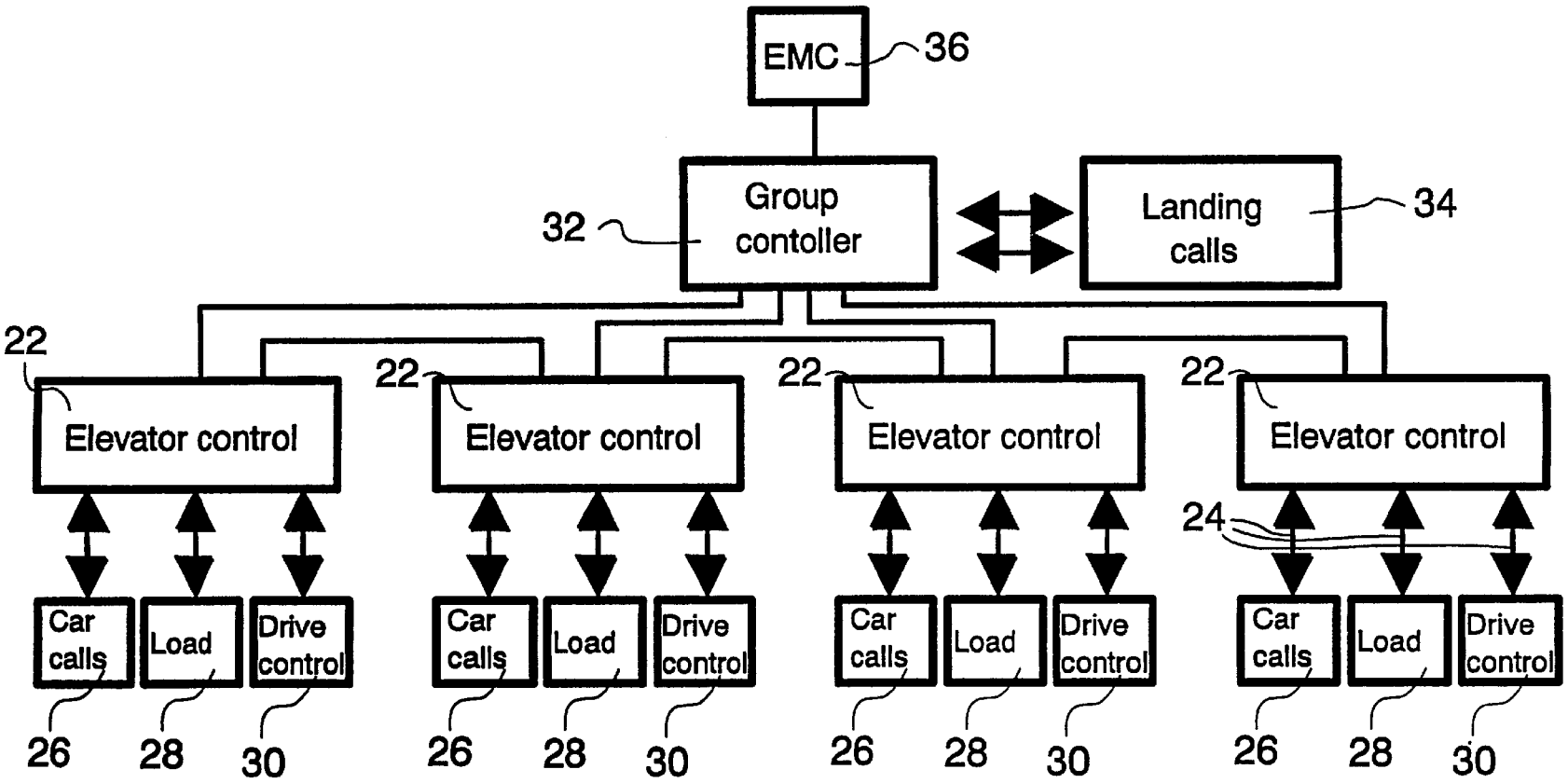

In the following, the invention will be described by the aid of some of its embodiments by referring to the drawings, in which:

FIG. 1 presents a schematic illustration of a double-deck elevator group,

FIG. 2 presents a diagram representing the control of the elevator group, and FIG. 3 illustrates the control of a group of double-deck elevators.

The diagram in FIG. 1 represents an elevator group 2 comprising four double-deck elevators 4. Each elevator comprises and elevator car 6, which has a lower deck 8 and above it an upper deck 10. The elevator car is moved in an elevator shaft 12 e.g. using a traction-sheave machine, and the cars are suspended on ropes (not shown). In the example in the figure, the building has fourteen floors, and the lower deck 8 can be used to travel between the first floor 14 and the thirteenth 18 floor and, correspondingly, the upper deck 10 can be used to travel between the second 16 and the fourteenth 20 floors. An escalator is provided at least between the first and second floors to let the passengers move to the second floor. In this case, the first and second floors are entrance floors, i.e. floors where people enter the building and take an elevator to go to upper floors.

Both elevator decks are provided with call buttons for the input of car calls to target floors, and the landings are provided with landing call buttons, by means of which passengers can order an elevator to the floor in question. In a preferred embodiment, on the first floor and on the lower deck it is only possible to give a car call to every other floor, e.g. to odd floors, and similarly on the second floor and on the upper deck it is only possible to give a car call to every other floor, eg. to even floors. Car calls from higher floors to any floors are accepted. The entrance floors are provided with signs to guide the passengers to the correct entrance floors. In addition, the call buttons for the non-allowed floors are hidden from view when the elevator is at the lowest stopping floor or the illuminated circle around the call button is caused to become a different colour. The cars and landings are provided with sufficient displays to inform the passengers about the target floors.

FIG. 2 is a schematic illustration of the control system of an elevator group, which controls the elevators to serve the calls given by passengers. Each elevator has its own elevator controller 22, to which the car calls entered by passengers using the car call buttons 26 are taken via a serial communication link 24. The car calls from both the lower and the upper decks are taken to the same elevator controller 22. The elevator controller also receives load data from the load weighing devices 28 of the elevator, and the drive control 30 of the elevator machinery also works under the elevator controller. The elevator controllers 22 are connected to a group controller 32, which-controls the functions of the entire elevator group, such as the allocation of landing calls to different elevators. The elevator controllers are provided with micro computers and memories for the calculation of cost functions during the call allocation. An essential part of this function is the landing calls 34, which are taken via serial links to the group controllers. The entire traffic flow and its distribution in the building are monitored by an elevator monitoring and command system 36.

Landing calls given from each floor for upward and downward transport are so served that the passenger waiting time and ride time, i.e. the time spent inside the car before reaching the destination floor, will be minimised. In this way, the journey time, i.e. the total time a passenger spends in the elevator system, is minimised which decreases the number of elevator stops and the capacity of the elevator group is maximised. Based on the status data concerning passengers and elevators and making use of statistics and history data, decisions are made about the allocation of landing calls to different elevators. A traffic forecaster produces forecasts of passenger traffic flows in the building. The prevailing traffic pattern is identified using fuzzy logic rules. Forecasts of future traffic patterns and passenger traffic flows are used in the selection of cars for different calls.

FIG. 3 illustrates the various stages of the acquisition and processing of data. From the passenger and elevator status data 38, the passenger flow is detected (block 40). Traffic flows can be detected in different ways. Passenger traffic information is obtained e.g. from detectors and cameras placed in the lobbies and having image processing functions. These methods are generally only used on the entrance floors and on certain special floors, and the entire traffic flow in the building cannot be measured. The stepwise changes in the load information can be measured, and it is used to calculate the number of entering and exiting passengers. The photocell signal is used to verify the calculation result. Passenger destination floors are deduced from the existing and given car calls.

Traffic statistics and traffic events are used to learn and forecast the traffic, block 42. Long-time statistics comprise entering and exiting passengers on the elevators at each floor during the day. Short-time statistics comprise traffic events, such as the states, directions and positions of car movement, landing calls and car calls as well as traffic events relating to passengers during the last five minutes. Data indicating the traffic components and required traffic capacity are also stored in the memory, In block 44, the traffic pattern is recognised using fuzzy logic. As for the implementation of this, reference is made to specification U.S. Pat. No. 5,229,559, in which it is described in detail.

The allocation of landing calls (block 46) in a group consisting of double-deck elevators, carried out by the group control system, utilises the above-described forecasts and passenger and elevator status data. Traffic forecasts are used in the recognition of the traffic pattern, optimisation of passenger waiting time and the balancing of service in buildings with more than one entrance. Traffic forecasts also influence parking policies and door speed control.

The best double-deck elevator is selected by optimising the passenger waiting time at the landing call floor and ride time inside the car. To optimise the waiting time, landing call time is weighted by the number of waiting passengers behind the call. The weighting coefficients depend on the estimated number of waiting passengers on each floor. When the landing call time and traffic flow on each floor are known, an estimate of the number of passengers behind the call is obtained by multiplying the call time by the passenger arrival rate at that floor. A probable destination floor for each passenger is obtained from the statistical forecasts of the number of exiting passengers at each floor. Car calls given from the landing call floor can then be estimated. By minimising the time from passenger arrival floor to destination floor, the passenger ride time is optimised The maximum ride time is minimised by minimising the longest car call time, or the time to the furthest car call.

The better deck to serve a landing call is selected by comparing the journey times internally for the elevator. The effects of a new landing call and new car calls are estimated separately for each deck. The passenger waiting and ride times are predicted and the landing call is allocated to the deck with the shortest journey time. According to one modification passenger waiting time and ride time to the furthest car call is predicted and the landing call is selected to the deck with minimum costs.

When the building has more than one entrance floor, in up-peak traffic and in two-way traffic, free elevators are returned to an entrance floor according to the prevailing traffic flow forecasts for these floors. During up-peak hours, cars going up can stop at entrance floors where an up-call is not on, if another elevator is loading at the floor.

Next, we shall consider the minimisation of passenger journey time, waiting time and ride time in a case according to the invention. During landing call allocation, the existing landing calls are sorted into descending order according to age. For each landing call and for each elevator the waiting time forecast WTF is calculated and the call is selected to the elevator with the shortest waiting time forecast. $WTF_{ele}$ is defined by the formula:

$$WTF_{ele}=\sigma*(CT+ETA_{ele}),$$

where

CT =current landing call time, i.e. the time the landing call has been active

σ=weight factor correlating to the estimated number of passengers behind call $$ETA_{ele}=\Sigma(t_d)+\Sigma(t_s)+t_r+t_a$$

$t_d$=drive time of one floor flight $t_s$=predicted time to stop at a floor $t_r$=predicted time that a car remains standing at floor $t_s$=additional time delay if e.g. the elevator has been ordered to park on certain conditions.

In the $ETA_{ele}$ expression, the summing expression $\Sigma(t_d)$ means the time required for the car to reach the landing call floor in its route while the summing expression $\Sigma(t_s)$ means the time required for the stops before the reaching the landing call floor. The terms $t_r$ and $t_s$ can be omitted in less accurate approximations.

The drive times for each floor have been calculated for each elevator in the group at the time of start-up of the group control program, using floor heights and nominal elevator speeds. The predicted stop time for an elevator is calculated by considering the door times and possible number of passengers transfers. The current landing call time is weighted by a factor σ in proportion to the number of persons behind the call. In this regard, reference is made to the patent U.S. Pat. No. 5,616,896. The number of persons on each floor and for each travel direction is obtained from statistical forecasts. In the calculation of ETA times, only those elevators that can serve the call are taken into account. The calculation does not include elevators that are not operating under group control or are fully loaded.

To optimise the journey time for persons, a landing call for a double-deck elevator is selected by minimising the passenger waiting time, and,the best deck to serve the landing call is selected by minimising the total time that passengers spend in the elevator system, the journey time.

Passenger waiting time is optimised by minimising the waiting time forecast $WTF_{ele}$ for each elevator, where the current landing call time CT is weighted by the number σ of persons waiting behind the call, and the cost function is of the form $$\min_{ele} WTF_{ele} = \min_{ele}(\sigma*(CT+ETA_{ele})),$$

where $ETA_{ele}$ is the estimated time of arrival of the elevator to the landing call.

Passenger journey time is minimised by allocating a landing call to the deck for which the landing call will cause the fewest additional stops and least additional delay on its way to the destination calls.

The estimated time of arrival to the destination floor is calculated separately for each deck by taking into account the existing stops of the elevator and the additional stops caused by the selected landing call. The landing call is allocated to the deck for which the sum of the waiting time forecast and the estimated time of arrival at the destination floor is smallest.

For each landing call, the best deck is selected by minimising the cost function. In the cost function J, the sum of waiting time forecast and estimated time of arrival $ETA_d$ to the destination floors is minimised, and the function is of the form $$J = \min_{deck}(\sigma*(CT+ETA_{ele}+ETA_d))$$

$$= \min_{deck}\left(\sigma*\left(CT \begin{array}{c}\text{landing call}\\ \text{floor}\\ +\\ \text{deck}\\ \text{position}\end{array} \sum(t_d+t_s) \begin{array}{c}\text{destination}\\ \text{call floor}\\ +\\ \text{landing call}\\ \text{floor}\end{array} \sum(t_d+t_s)\right)\right)$$

where $t_d$ is the drive time for one floor flight and $t_s$ is the predicted stop time at a floor. In the summing functions, the time required for the drive from one floor to another and the time consumed during stops on the route are calculated. In the waiting time forecast the estimated time of arrival from the deck position to the landing call floor is calculated, and the estimated time of the arrival $ETA_d$ to the destination floor is calculated from the landing call floor to the destination floor.

In a practical application the estimated time of arrival of the destination floor is optimised to the furthest car call floor. Accordingly, the estimated time of arrival $ETA_f$ to the furthest call floor is minimised, and the cost function $J_f$ is of the form $$J_f = \min_{deck}(ETA_f)$$

$$= \min_{deck}\left(\begin{array}{c}\text{furthest}\\ \text{car call floor}\\ \sum\\ \text{deck}\\ \text{position}\end{array}(t_d+t_s)\right)$$

where $ETA_f$=estimated time of arrival of a car to the furthest call floor when starting from the deck position floor $t_d$=drive time for one floor flight $t_s$=forecast stop time at a call floor.

In the calculation of ETA, the future stops and stop times are based on the existing car call and landing call stops and on the additional stops and additional delays caused by the call to be selected. The additional delays caused by the landing call to be selected are obtained from the statistical forecasts of the passenger traffic, which are based on passenger arrival and departure floors at that time of the day. The car load is monitored and if the load exceeds the full load limit, then no more landing calls are allocated for that deck. In the entrance lobby, the upper deck can only be given car calls to even floors while the lower deck can only be given car calls to odd floors. After leaving the entrance floor each deck can serve any of the floors.

According to these cost functions whole the passenger journey time is optimised for each deck. Also here the additional delays $t_r$ and $t_a$ can be added if it is considered necessary.

The invention has been described above by the aid of some of its embodiments. However, the description is not to be regarded as constituting a limitation, but the embodiments of the invention may be varied within the limits defined by the following claims.

What is claimed is:

1. In a system of plural elevators arranged in an elevator group and being driven by a drive system allowing coordinated control of each elevator of said elevator group by an elevator control, the individual elevators having multiple decks accessing plural adjacent floors, each elevator including at least an upper deck and a lower deck, a method of controlling the elevator group comprising:

a) monitoring passenger flow and elevator status within said elevator group;

b) based on the information obtained in said step a), estimating passenger wait time and ride time;

c) selecting the best elevator of the elevator group to minimize estimated passenger wait time and ride time, based on the estimated passenger wait time and ride time;

d) selecting the best deck of said multiple decks based on the estimated wait time and ride time so as to minimize passenger journey time of the passengers to the passenger selected destination floors;

e) transferring said best elevator to the selectable call floor based on said selection in step c); and f) directing the best deck of said multiple decks to answer the call at the selectable call floor based on said selection in said step d).

2. The method of claim 1 wherein said step b) estimates passenger wait time and ride time based on traffic prediction.

3. The method of claim 1 wherein said step c) selects the best deck of said multiple decks based on traffic prediction.

4. The method of claim 1 wherein said step a) of monitoring monitors destination call data from the landing floors, said step b) basing the estimate of passenger wait time and ride time on the destination call data from the landing floors.

5. The method of claim 2 wherein fuzzy logic is used to predict future elevator traffic.

6. The method of claim 3 wherein fuzzy logic is used to predict the best deck based on future elevator traffic.

7. The method as defined in claim 1, wherein the journey time, includes a passenger waiting time at the landing call floor and ride time inside a car to the destination floor, the passenger journey time being optimized by minimizing the passenger waiting time and ride time.

8. The method as defined in claim 1, wherein the passenger waiting time is optimized by minimizing a waiting time forecast $WTF_{ele}$, where the current landing call time CT is weighted by the number of persons waiting behind the call σ and the cost function is of the form:

$$\min_{ele} WTF_{ele} = \min_{ele}(\sigma * (CT + ETA_{ele}(,))$$

where $ETA_{ele}$ is the estimated time of arrival of a car to the landing call.

9. The method as defined in claim 1, wherein the passenger journey time is minimized by allocating the landing call to the deck that will cause the fewest additional stops to the elevator and least additional delay on the way to the passenger destination floor.

10. The method as defined in claim 1, wherein the elevator estimated time of arrival ETA to the destination floor is calculated separately for each deck, taking into account the stops already existing for the elevator and the additional stops caused by the selected landing call, and the landing call is allocated to the deck for which the estimated time of arrival to the destination floor is smallest.

11. The method as defined in claim 1, wherein the best deck for each landing call is selected by minimized the cost function.

12. The method as defined in claim 1, wherein, in the cost function J, the estimated time of arrival $ETA_d$ to the destination floor is minimized, and the function is of the form:

$$J = \min_{deck}(\sigma * (CT + ETA_{ele} + ETA_d)) = \min_{deck}\left(\sigma * \left(CT + \sum_{\substack{deck \\ position}}^{\substack{landing\ call \\ floor}} (t_d + t_s) + \sum_{\substack{landing\ call \\ floor}}^{\substack{destination \\ call\ floor}} (t_d + t_s)\right)\right)$$

where

σ=number of persons waiting behind the call

CT=current landing call time $ETA_{ele}$=estimated time of arrival of a car to the landing call $ETA_d$=estimated time of arrival of a car to the destination call floor when starting from the landing call floor $t_d$=drive time for one floor flight $t_s$=forecast stop time at a call floor.

13. The method as defined in claim 11, wherein, in the cost function J, the estimated time of arrival $ETA_f$ to the furthest call floor is minimized, and the function is of the form:

$$J_f = \min_{deck}(ETA_f) = \min_{deck}\left(\sum_{\substack{deck \\ position}}^{\substack{furthest \\ car\ call\ floor}} (t_d + t_s)\right),$$

where $ETA_f$=estimated time of arrival of a car to the furthest call floor when starting from the deck position floor $t_d$=drive time for one floor flight $t_s$=forecast stop time at a call floor.

14. The method of claim 12, wherein, in the calculation of ETA, the future stops and stop times are based on the existing car calls and landing call stops and on the additional stops and delays caused by the call to be selected.

15. The method of claim 14, wherein the additional delays caused by the landing call to be selected are obtained from the statistical forecasts of passenger traffic, which includes passenger arrival and exit rates at each floors at each time of the day.

16. The method as defined in claim 1, wherein stop a) includes the substep of determining the car load where in steps b) and c), if the load exceed the full load limit, then no more landing calls are allocated for that deck.

17. The method as defined in claim 1, wherein, at the main lobby, the upper deck and the lower deck accept car calls only to every other floor.

18. The method as defined in claim 1, wherein when leaving the entrance floor the lower deck serves odd floors and the upper deck serves the even floors when the lowest floor is marked by number 1.

19. The method as defined in claim 1, wherein, at the upper floors, except for the top floor, each deck can stop at any floor when serving the calls.

* * * * *